US011021664B2

(12) United States Patent
Yang

(10) Patent No.: US 11,021,664 B2
(45) Date of Patent: Jun. 1, 2021

(54) HYDROCRACKING SYSTEM FOR PRODUCING DISTILLATE OR NAPTHA

(71) Applicant: PHILLIPS 66 COMPANY, Houston, TX (US)

(72) Inventor: Xiangxin Yang, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 67 days.

(21) Appl. No.: 16/710,228

(22) Filed: Dec. 11, 2019

(65) Prior Publication Data

US 2020/0181512 A1 Jun. 11, 2020

Related U.S. Application Data

(60) Provisional application No. 62/778,069, filed on Dec. 11, 2018, provisional application No. 62/778,077, filed on Dec. 11, 2018.

(51) Int. Cl.

| | |
|---|---|
| ***C10G 65/12*** | (2006.01) |
| ***B01J 8/02*** | (2006.01) |
| ***B01J 8/04*** | (2006.01) |
| ***C10G 47/36*** | (2006.01) |
| ***C10G 47/10*** | (2006.01) |

(52) U.S. Cl.

CPC ..... *C10G 65/12* (2013.01); *C10G 47/10* (2013.01); *C10G 47/36* (2013.01); *C10G 2300/4081* (2013.01); *C10G 2400/02* (2013.01); *C10G 2400/04* (2013.01)

(58) Field of Classification Search

None

See application file for complete search history.

(56) References Cited

U.S. PATENT DOCUMENTS

| | | | | |
|---|---|---|---|---|
| 3,260,663 | A * | 7/1966 | Inwood | C10G 65/12 208/59 |
| 2007/0056879 | A1* | 3/2007 | Euzen | B01J 21/12 208/108 |
| 2007/0118008 | A1* | 5/2007 | Euzen | C10G 65/18 585/752 |
| 2012/0031811 | A1* | 2/2012 | Cowan | C10G 47/16 208/57 |
| 2013/0001127 | A1* | 1/2013 | Aubry | C10G 45/44 208/18 |
| 2016/0136603 | A1* | 5/2016 | Parihar | B01J 8/0257 208/108 |
| 2020/0181511 | A1* | 6/2020 | Yang | C10G 65/12 |

* cited by examiner

*Primary Examiner* — Tam M Nguyen
(74) *Attorney, Agent, or Firm* — Phillips 66 Company

(57) ABSTRACT

The invention relates to a catalytic hydrocracker with two different catalyst beds within the reactor where each is loaded with a catalyst that has different hydrocracking properties. A first catalyst bed preferably cracks heavy oil more aggressively than the catalyst in the second bed. The catalytic hydrocracker includes further two recycle lines such that one directs unconverted oil through both hydrocracker beds and a bypass inlet is positioned between the first and second catalyst beds to admit unconverted oil to pass only through the second less aggressive hydrocracker catalyst bed. When gasoline prices favor the production of gasoline, less unconverted oil is recycled through the bypass therefore making more gasoline, but when prices favor the production of j et and diesel, more recycle is directed through the bypass recycle thus making less gasoline and more diesel and jet fuel.

5 Claims, 2 Drawing Sheets

HYDROCRACKING SYSTEM FOR PRODUCING DISTILLATE OR NAPTHA

CROSS-REFERENCE TO RELATED APPLICATIONS

This application is a non-provisional application which claims benefit under 35 USC § 119(e) to U.S. Provisional Application Ser. No. 62/778,069 filed Dec. 11, 2018, entitled "Hydrocracking Process for Producing Distillate or Naptha" and also to U.S. Provisional Application Ser. No. 62/778,077 filed Dec. 11, 2018, entitled "Hydrocracking Process for Producing Distillate or Naptha", both of which are incorporated herein in their entirety.

STATEMENT REGARDING FEDERALLY SPONSORED RESEARCH OR DEVELOPMENT

None.

FIELD OF THE INVENTION

This invention relates to refining hydrocarbons and more particularly to hydrocracking heavy hydrocarbon distillation cuts to intermediates to supply gasoline and diesel where market prices for gasoline and diesel shift seasonally between the summer and winter and it is desirable to produce a product slate that optimizes total product make to take best advantage of prices throughout the year.

BACKGROUND OF THE INVENTION

There are many moving parts in the operation of a crude oil refinery. One recurring issue in operating a refinery is to be continually aware of product prices to be able to shift production in response to market conditions or opportunities where some products may run in short supply in the market and prices for those products may become more profitable for a time. Unfortunately, not many refinery operations are not amenable to readily shifting of products slates. For example, it is known that prices for gasoline are generally higher in the summer as demand increases and as total gasoline produced by all refineries effectively decreases due to more stringent summer fuel specifications that limit the amount of certain light constituents in sellable gasoline. All refinery operators would love to be able to adjust production of their product slate to take full advantage of these foreseeable price opportunities, but current refinery technology for making both diesel and gasoline has very limited capability for altering product proportions while in operation.

Refineries are able to shift somewhat at a refinery turn around by altering the catalysts and rearranging certain plumbing, but most refineries are optimized to produce the maximum potential product volumes based on the crude oils available in the region with due respect to anticipated demand for various refinery products. So, at a turnaround for a refinery, it would be expected to set up an optimal arrangement or design for a period of years and not for quick adjustment or even seasonal adjustment. Once the turnaround is complete and the refinery is fully operational again, it should be expected run for years with little ability to alter the relative volumes of certain products as compared to other products. Typically, gasoline and diesel are the two most preferred products, but biasing the relative volumes between gasoline and diesel are not practical in operation. And while refinery turnarounds are necessary, it is generally preferred to push them off as long as practical as refinery turnarounds are expensive. For instance, one factor considered by investors in refining companies is the percentage of productivity of the refineries recognizing that turn arounds cut in to refinery up time and total productivity.

If technology were available for adjusting or shifting from diesel to gasoline or back while producing high volumes, it would be highly desirable. This would be especially true if such technology were reliable and would not require any level of refinery shutdown reduced production.

BRIEF SUMMARY OF THE DISCLOSURE

The invention more particularly relates to a system for converting heavy hydrocarbons to naphtha and diesel components in a hydrocracker within a refinery including a hydrotreater for hydrotreating heavy hydrocarbons to produce hydrotreated heavy hydrocarbons and a hydrocracker for hydrocracking the hydrotreated heavy hydrocarbons. The hydrocracker includes an inlet at the top, an outlet at the bottom for hydrocracked products and an inlet at a midpoint between the top and the bottom. The hydrocracker further includes a top fixed bed between the top and the midpoint where the top fixed bed includes a naphtha selective catalyst and where the hydrocracker further includes a bottom bed below the midpoint inlet and above the outlet and where the bottom bed includes a diesel selective hydrocracking catalyst. The hydrocracker is further arranged such that feedstock supplied at the top inlet passes through both the top bed and the bottom bed and feedstock supplied at the midpoint inlet does not pass through the top bed, but only passes through the bottom bed. The system includes a feed conduit to supply hydrotreated heavy hydrocarbons from the hydrotreater to the hydrocracker and a separator for separating the hydrocracked products into a gasoline constituent, a diesel constituent and a heavy constituent. The hydrocracker effluent conduit is provided for conveying the hydrocracked product to the separator and a gasoline advantaged recycle conduit is provided for recycling at least a part of the heavy constituent from the separator to the top of the hydrocracker where the heavy constituent is passed through both the top bed and the bottom bed for at least a second time. The system also includes a diesel advantaged recycle conduit for recycling at least a part of the heavy constituent from the separator to the midpoint inlet of the hydrocracker where the heavy constituent is passed through the bottom bed for at least a second time and not passed through the top bed for this second time and valves are provided for adjusting the relative portions that are passed through each of the gasoline advantaged recycle conduit and the diesel advantaged recycle conduit to produce more of one of gasoline or diesel depending on the better profitability of one product versus the other.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
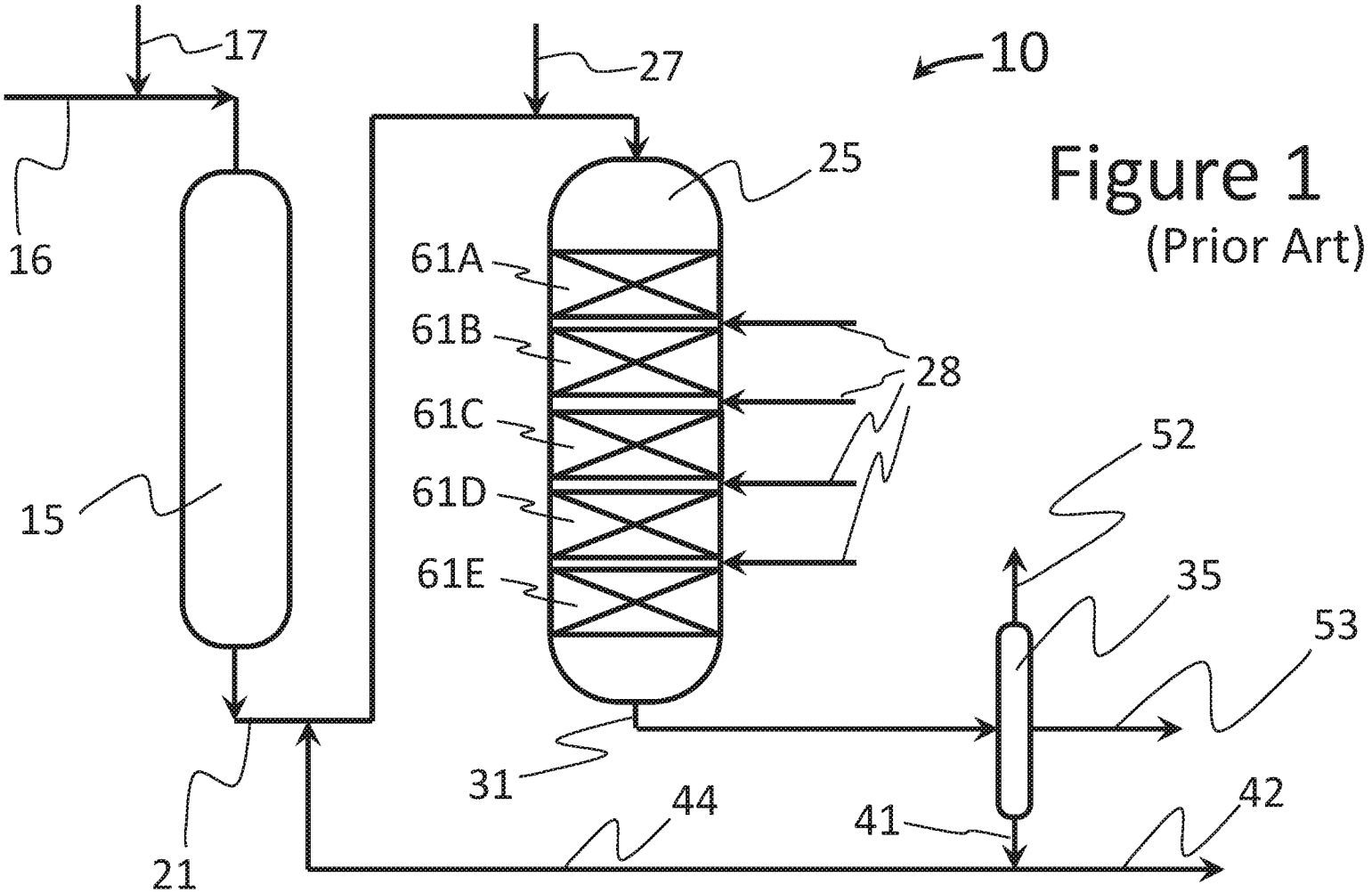
Figure 1 (Prior Art)
FIG. 1 is diagram of a prior art arrangement for hydrotreating and hydrocracking a heavy crude oil fraction in an oil refinery.

Turning now to the drawings, it should first be understood that in conventional refinery arrangements start the refining process by separating crude oil into constituent parts based on distillation cuts points first using an atmospheric distillation tower (not shown). The various cuts are directed for further processing where the bottom cut, or cuts are forwarded to a vacuum distillation tower (not shown) which cuts the heavy oil into separate distillation fractions. The bottom cuts from the vacuum distillation tower tend to comprise larger and denser hydrocarbon molecules that have much less value than jet fuel, diesel and gasoline range molecules. It is conventional to try and crack these larger specie molecules into smaller molecules using a catalyst with the objective to turn these low value molecules into much higher value gasoline or diesel range molecules. In FIG. 1, a system for converting heavy hydrocarbons to gasoline and diesel range materials is generally indicated by the numeral 10 which principally includes a catalytic hydrotreater 15 and a catalytic hydrocracker 25. The catalytic hydrotreater 15 is shown as receiving a heavy hydrocarbon stream in line 16 with hydrogen is supplied by line 17. Within the reactor 15 is hydrotreating catalyst and the hydrocarbons and hydrogen are provided at a temperature (~700° F.) and an elevated pressure to convert organic nitrogen-containing compounds to ammonia and also to remove sulfur-containing compounds and saturate aromatics. Nitrogen is a catalyst poison to catalysts in downstream processes and can be removed from the heavy stream as ammonia.

The hydrotreated heavy oil is delivered from hydrotreater 15 to hydrocracker 25 via line 21. Additional hydrogen is added via line 27 and the temperature and pressure are modified to meet the catalytic conditions for the hydrocracking catalyst in one or more catalyst beds. Five such beds are shown in FIG. 1 and are numbered 61A-61E, respectively. Between each bed is a hydrogen injection port to add hydrogen and also for temperature quench as hydrocracking is rather exothermic. The cracked hydrocarbons are then directed via line 31 to separator 35. Naphtha is produced via line 52 for gasoline production while middle distillates for diesel and jet fuel are directed to line 53. The unconverted oil is produced from bottom line 41 and may be recycled via line 44 or directed elsewhere in the refinery via line 42. The recycle line 44 provides the unconverted oil back to the hydrocracker 25 by adding it to the fresh supply of heavy hydrocarbons from the hydrotreater 15.

The product slate produced by the system 10 is pretty much dictated by the crude oil supplied to the refinery and by the catalyst selection for the beds within the hydrocracker 25. Once the catalyst is selected and loaded in to the hydrocracker 25, the proportion of naphtha and diesel only shifts as the catalyst ages. Therefore, when gasoline prices are higher in the summer, a refinery using a system 10 is unable to really take advantage of that profit opportunity. To address that shortcoming, the inventive arrangement 100 is shown in FIG. 2 which provides some new flexibility in shifting the product between a more gasoline biased product slate or a more middle distillate biased slate where jet fuel and diesel are more desired.

Figure 2:
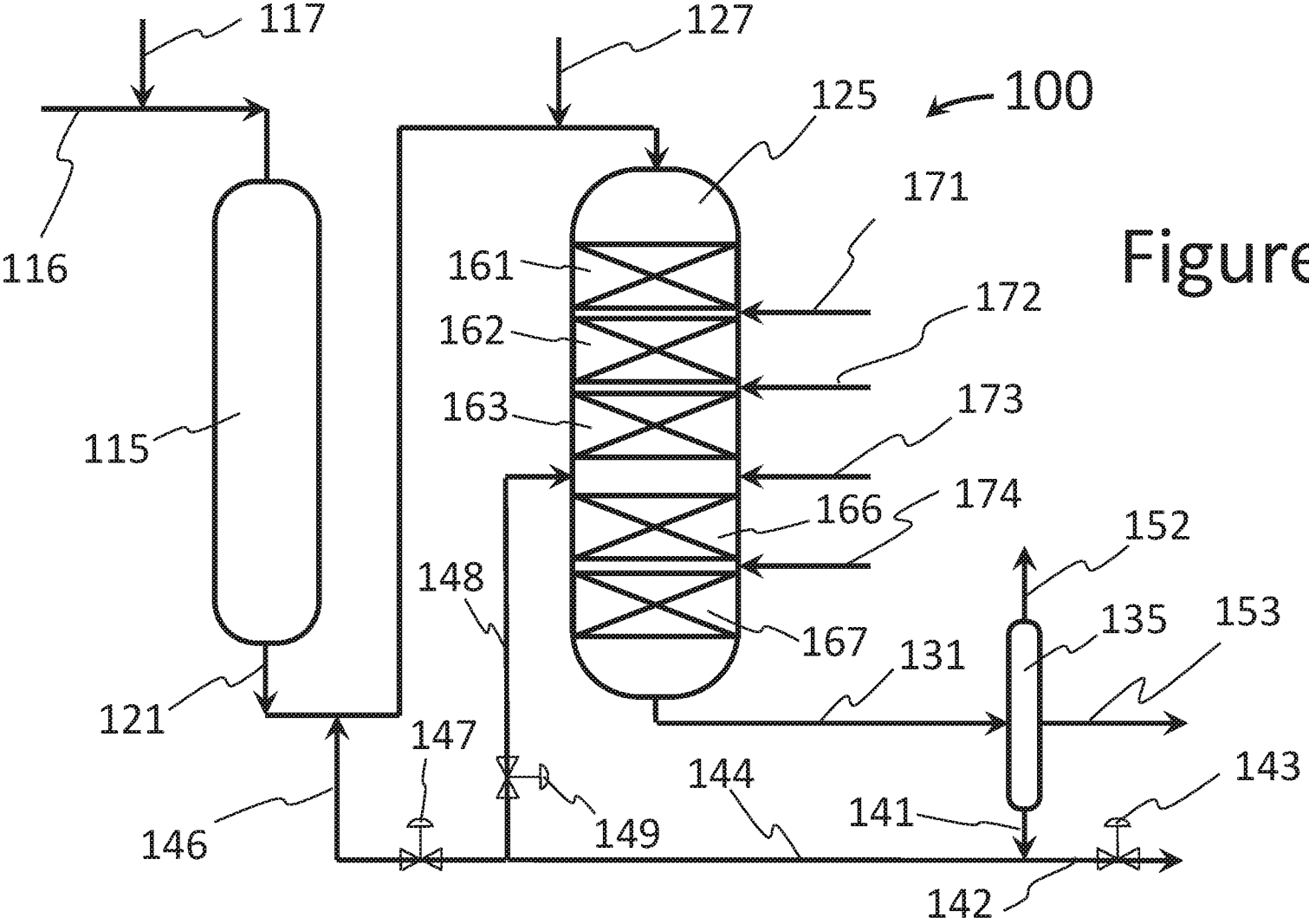
FIG. 2 is a diagram similar to FIG. 1 showing the inventive arrangement for a hydrotreater and hydrocracker that permits shifting the product slate relatively easily between gasoline on the one hand and jet fuel and diesel on the other.

Turning to FIG. 2, the heavy hydrocarbons are processed by the system generally indicated by the numeral 100. In system 100, the heavy hydrocarbons are again supplied to the hydrotreater 115 via line 116. Hydrogen is added to convert organic nitrogen-containing compounds to ammonia to protect the catalyst in the hydrotreater 125 and the hydrotreated heavy hydrocarbons are delivered via line 121 to the hydrocracker 125. Hydrocracker 125 is different than hydrocracker 25 in system 10 in that it includes a second feed inlet via pipe 148 at a midpoint of the reactor vessel. Above the midpoint of hydrocracker 125 are one or more catalyst beds (shown as three beds) 161, 162 and 163. These beds 161, 162 and 163 are packed with a first catalyst selected to have a certain product bias. In this embodiment, the catalyst in the first set of beds 160 have a high number of acid sites to more aggressively crack the heavy hydrocarbons to naphtha range products and such catalysts are described as naphtha selective hydrocracking catalyst. However, below the midpoint, additional catalyst beds 170 include hydrocracking catalyst that is chemically less aggressive, perhaps with fewer acid sites. The catalyst in catalyst beds 170 tends to crack the heavy hydrocarbons to molecules larger than naphtha and separate into a slightly heavier distillate cut that blends into diesel and jet fuel. This kind of catalyst is term a diesel selective catalyst.

Turning back to FIG. 2, the heavy hydrocarbon is fed to the hydrocracker 125 via line 121 with additional hydrogen as needed. The temperature and pressure of the feed are adjusted for desired catalytic conditions where the stream is acted upon by the catalyst. The products from the hydrocracker 125 are delivered via a line 131 to separator 135 where again the naphtha is taken off at line 152, the jet fuel and diesel fractions are taken at line 153 and the unconverted oil comes off the bottom at line 141. The flexibility of the inventive system 100 comes from the ability to control where the unconverted oil is directed. Valves 143, 147 and 149 are adjusted to deliver unconverted oil to the top of the hydrocracker when more gasoline is desired and to the midpoint of the hydrocracker 125 when more diesel and jet fuel is desired. A higher portion of unconverted oil may also be directed to other processes via line 142 through valve 143 when such unconverted oil has use or need in other systems within the refinery.

Typically, each of the three valves 143, 147 and 149 would permit some flow to keep systems hydraulically full, but they are adjusted to bias the product slate to increase or decrease portions of various fuels.

In applying the capabilities that the present invention brings to refining technology, it is observed that a typical hydrocracking unit, the feed passes over hydrotreating catalyst and hydrocracking catalyst in series, followed by a fractionator where the reactor effluent is cut into naphtha, diesel fuel, and/or unconverted oil (UCO). When conventional systems are operated with a hydrocracking catalyst that is supposed to be somewhat flexible between naphtha selectivity and diesel selectivity, these flexible zeolite/amorphous base catalysts are loaded in to the hydrocracking reactor and the operation mode can be shifted from naphtha to distillate or vice versa through changes in operating conditions which is mainly by trying to alter the reactor temperature through changes in the temperature of the feedstock from the hydrotreater and the temperature and volume of the hydrogen feed at the top of the reactor and in the quench zones between reactor beds. However, the maximum naphtha operation on such catalysts produces too much light hydrocarbon gases which do not contribute to profitability of the refinery and also accelerates catalyst deactivation in the reactor and shortens cycle length due to high temperature requirement by the catalysts. Cycle length is an important factor for refinery management as it requires a shutdown to replace the catalyst and a new start up process all of which typically takes days.

Also, when operating at the maximum-distillate operation the conditions are hard on such catalysts due to their smaller pore sizes compared to distillate-selective catalysts or diesel selective catalysts. In the present invention the top reactor beds 161, 162 and 163 include zeolitic base catalyst and the bottom beds 166 and 167 include amorphous base catalyst. These are instead of one flexible catalyst in all of the five beds.

As described above, some unconverted oil is recycled back to the amorphous catalyst bed in the reactor for further conversion. When in the naphtha biased-mode, the stacked catalysts in the current invention produce higher naphtha yield and lower gas make compared to flexible catalyst. For distillate-mode operation, the activity of zeolitic catalyst on the top can be temporarily depressed by slightly higher nitrogen slip from the hydrotreater and the amorphous base catalyst at the bottom preferentially cracks large molecules such as partially saturated polynuclear compounds. Therefore, the distillate yield can be improved relative to the yield obtained with flexible catalyst. The higher nitrogen slip decreases the severity in the hydrotreating reactor and the run length of hydrotreater is extended which creates higher system utilization and lower costs. During the cycle, the adjustment of the operation of treating reactor decreases nitrogen slip and the lost activity of cracking catalyst due to coke lay-down is compensated and the distillate yield is similar throughout the cycle. Depending on the properties of the feedstocks and catalysts, catalysts on the top can include one or multiple zeolitic base catalysts and catalysts at the bottom can include one or multiple amorphous or low zeolite-containing base catalysts. The ratio between these two types of catalysts is also dependent on the properties of the feedstock and catalysts.

In practice, a base case operation is established for each of a naphtha mode and a diesel mode by using a designed flexible catalyst that shifts production based on a change in operating temperature. At a naphtha or gasoline preference, the base case is shown in the table below and when operating at a lower, diesel preference mode, that base case is shown below. In comparison, using the present invention and shifting the recycle path possibly along with some temperature adjustment, better results in both modes are shown in the table below. While the relative weight percentage changes do not appear to be huge, in practice, this much flexibility can make a significant improvement in the financial performance of a refinery.

| | Operation mode (naphtha) | | Operation mode (diesel) | |
|---|---|---|---|---|
| Yields, wt % | Base case | New Case | Base case | New Case |
| Gases | 11.0 | 8.5 | 5.0 | 4.0 |
| Naphtha | 50.1 | 51.6 | 40.1 | 38.5 |
| Diesel | 35.1 | 36.1 | 51.1 | 53.7 |
| UCO | 5.0 | 5.0 | 5.0 | 5.0 |

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A system for converting heavy hydrocarbons to naphtha and diesel components in a hydrocracker within a refinery, wherein the system comprises:

a hydrotreater for hydrotreating heavy hydrocarbons to produce hydrotreated heavy hydrocarbons;

a hydrocracker for hydrocracking the hydrotreated heavy hydrocarbons where the hydrocracker comprises an inlet at the top, an outlet at the bottom for hydrocracked products, an inlet at a midpoint between the top and bottom, a top fixed bed between the top and the midpoint where the top fixed bed includes a naphtha selective catalyst and where the hydrocracker further includes a bottom bed below the midpoint inlet and above the outlet and where the bottom bed includes a diesel selective hydrocracking catalyst and where the hydrocracker is arranged such that feedstock supplied at the top inlet passes through both the top bed and the bottom bed and feedstock supplied at the midpoint inlet does not pass through the top bed, but only passes through the bottom bed;

a feed conduit to supply hydrotreated heavy hydrocarbons from the hydrotreater to the hydrocracker;

a separator for separating the hydrocracked products into a gasoline constituent, a diesel constituent and a heavy constituent;

hydrocracker effluent conduit for conveying the hydrocracked product to the separator;

a gasoline advantaged recycle conduit for recycling at least a part of the heavy constituent from the separator to the top of the hydrocracker where the heavy constituent is passed through both the top bed and the bottom bed for at least a second time;

a diesel advantaged recycle conduit for recycling at least a part of the heavy constituent from the separator to the midpoint inlet of the hydrocracker where the heavy constituent is passed through the bottom bed for at least a second time and not passed through the top bed for this second time; and valves for adjusting the relative portions that are passed through each of the gasoline advantaged recycle conduit and the diesel advantaged recycle conduit to produce more of one of gasoline or diesel depending on the better profitability of one product versus the other.

2. The system according to claim 1 where the top bed comprises a plurality of fixed beds.

3. The system according to claim 1 where the bottom bed comprises a plurality of fixed beds.

4. The system according to claim 1 further including a hydrogen quench injector between each of the catalyst beds.

5. The system according to claim 1 where the gasoline advantaged recycle conduit connects to the feed conduit that supplies the hydrotreated heavy products from the hydrotreater to the hydrocracker where both hydrotreated heavy products and recycled heavy constituent are provided to the hydrocracker at the top inlet.

* * * * *